US005492601A

United States Patent [19]

Ostermayer et al.

[11] Patent Number: 5,492,601

[45] Date of Patent: Feb. 20, 1996

[54] LASER APPARATUS AND METHOD FOR MONITORING THE DE-WATERING OF STOCK ON PAPERMAKING MACHINES

[75] Inventors: Volker Ostermayer, Greenville; Thomas B. Fleischer, Pelzer, both of S.C.; Gilles F. Duquette, Roswell, Ga.

[73] Assignee: Wangner Systems Corporation, Greenville, S.C.

[21] Appl. No.: 282,924

[22] Filed: Jul. 29, 1994

[51] Int. Cl.[6] ..... D21F 7/00; G01N 21/90

[52] U.S. Cl. ..... 162/198; 162/263; 162/DIG. 10; 356/256; 356/426; 250/339.11

[58] Field of Search ..... 162/258, 198, 162/262, 263, 252, DIG. 10, DIG. 11; 356/375, 381, 400, 399; 250/339.1, 339.11, 339.12, 341.7, 341.8; 73/159; 364/563, 556; 33/DIG. 21, 517

[56] References Cited

U.S. PATENT DOCUMENTS

| | | | |
|---|---|---|---|
| 3,522,023 | 1/1971 | Freeh | 73/159 |
| 3,614,450 | 10/1971 | Hill | 250/210 |
| 3,634,187 | 1/1972 | Chari et al. | 162/198 |
| 3,649,444 | 3/1972 | Futch, Jr. | 162/198 |
| 3,671,726 | 6/1972 | Kerr | 364/563 |
| 3,713,966 | 1/1973 | Lippke | 162/263 |
| 3,847,730 | 11/1974 | Doering | 162/198 |
| 3,851,175 | 11/1974 | Dahlin | 250/339 |
| 3,936,665 | 2/1976 | Donoghue | 364/469 |
| 4,453,404 | 6/1984 | Powell et al. | 73/159 |

FOREIGN PATENT DOCUMENTS 2260408 4/1990 United Kingdom .

*Primary Examiner*—W. Gary Jones
*Assistant Examiner*—Jose A. Fortuna
*Attorney, Agent, or Firm*—Cort Flint

[57] ABSTRACT

An apparatus and method for measuring the de-watering performance of a forming section of a papermaking machine is disclosed which includes a laser instrument assembly having first and second laser displacement meters laterally spaced and supported above an upper run of a paper forming fabric. A head box deposits paper stock consisting of a water/fiber mixture on top of the upper run. An adjustable carrier stand supports the laser instrument assembly above the upper run of the forming fabric. The first laser displacement meter is disposed in a first position above the forming fabric so that a laser beam of the first laser meter is reflected off of the paper stock which is deposited on top of the forming fabric. The second laser displacement meter is disposed in a second position above said forming fabric so that a laser beam of the second laser displacement meter is reflected off of a bare edge of the forming fabric. The laser meters generate first and second signals representing the displacement of the top surface of the paper stock and base surface of the forming fabric. A controller receives the first and second signals and generates an output indicating the thickness of the paper stock, and hence the water content of the stock.

30 Claims, 3 Drawing Sheets

Fig. 2.
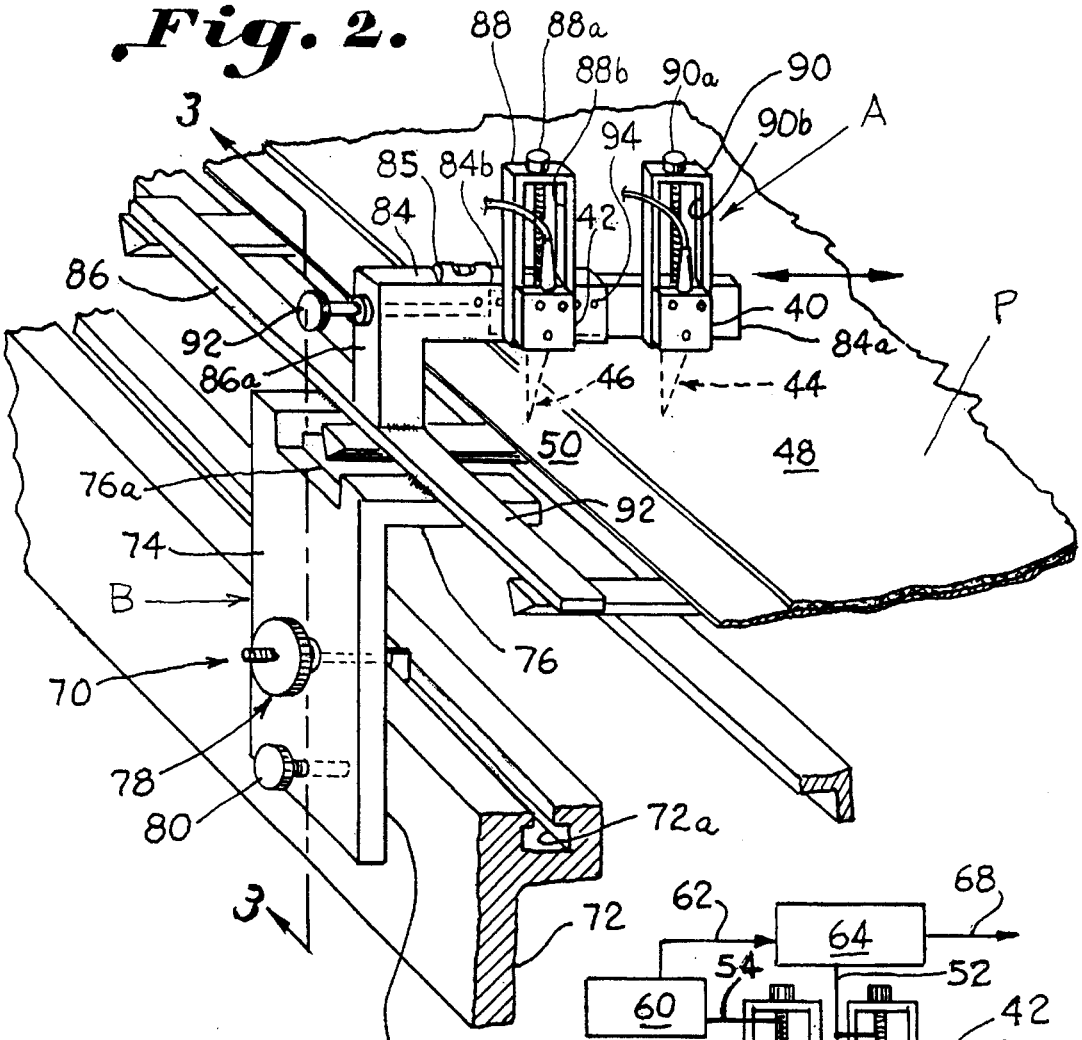
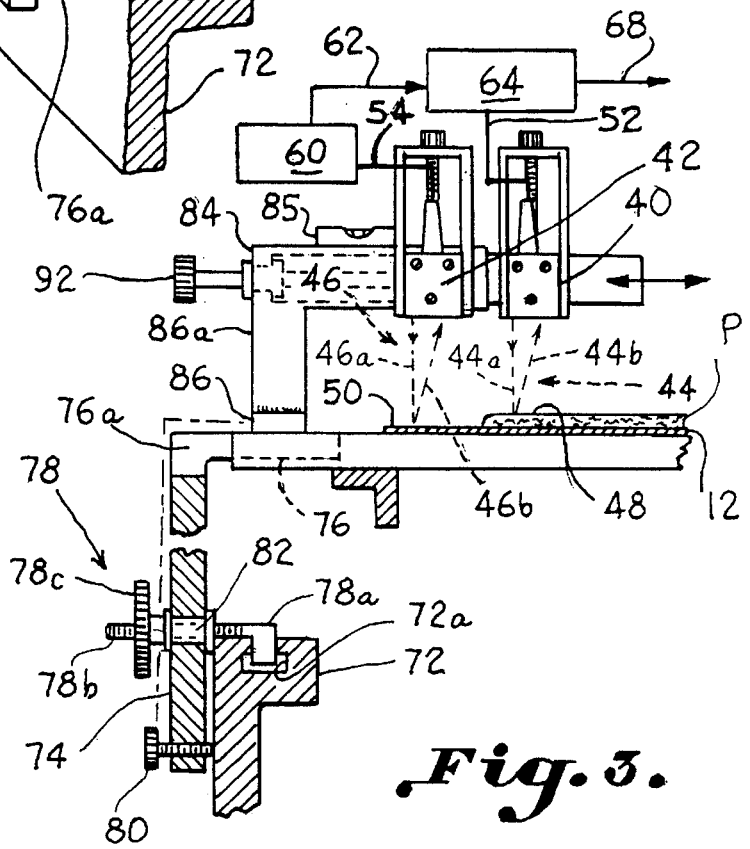
Fig. 3.

LASER APPARATUS AND METHOD FOR MONITORING THE DE-WATERING OF STOCK ON PAPERMAKING MACHINES

BACKGROUND OF THE INVENTION

The invention is directed to an apparatus and method for measuring and monitoring the de-watering of paper stock in the forming section of a papermaking machine.

In the manufacture of paper on papermaking machines, a web of paper is formed from an aqueous suspension of fibers (stock) on a traveling mesh papermaking fabric and water drains by gravity and suction through the fabric. The web is then transferred to the pressing section where more water is removed by pressure and vacuum. The web next enters the dryer section where steam heated dryers and hot air completes the drying process. The paper machine is, in essence, a giant de-watering, i.e, water removal, system. The largest of water is taken out in the forming section as the stock is de-watered from a consistency to 0.2%–1½% solids to a web having a consistency of about 18%–25% solids. A typical forming section of a papermaking machine includes an endless traveling papermaking fabric or wire which travels over a series of water removal elements such as table rolls, foils, vacuum foils, and suction boxes. The stock is carried on the top surface of the papermaking fabric and is de-watered as the stock travels over the successive de-watering elements to form a sheet of paper. Finally, the wet sheet is transferred to the press section of the papermaking machine where enough water is removed to form a sheet of paper with about 36%–44% solids. The various de-watering stations in the forming section have rated capabilities for de-watering. It is advantageous to be able to measure the actual de-water occurring in the stock to determine if performing according to its capabilities.

Various devices have been proposed for monitoring the de-watering or drainage efficiency of the papermaking fabric along the forming section. For example, it is know to use an ultrasonic meter to monitor the de-watering efficiency along the forming section. An ultrasonic transistor is placed at different positions under the papermaking fabric and a pulse of ultrasonic energy is reflected from the stock/air interface on top of the fabric. In this manner, information as to thickness of the stock, and hence the degree of de-watering, is obtained. However, since the ultrasonic meter measures the distance to the stock/air interface, there may be variations in the measurements which are not caused by changes in the moisture content. These variations may be due to disturbances in the surface, or due to air entrapment. To over come the deficiencies of the ultrasonic devices, Great Britain Patent No. 2,260,408 discloses a microwave moisture meter for monitoring the de-watering efficiency along the forming section. A microwave moisture meter is placed underneath the fabric, and energy is directed through the fabric and the stock by the meter. Modification of the microwave energy caused by the moisture content of the stock is monitored by the meter. It is said that this arrangement allows the moisture content to be measured substantially without having to make complicated or inconvenient allowances for variations in other parameters.

However, the problem with both the ultrasonic and microwave moisture meters is such meters are operated underneath the papermaking fabric in the forming section of the papermaking machine. This creates difficulty in the ease at which the de-watering measurements may be taken, and can effect the accuracy of the measurements as well.

In addition, it is known to use a device commonly referred to as a Gama- gauge to measure the de-watering efficiency at the various stations in the forming section. However, safety problems due to the radiation associated with these type of devices cannot be entirely ruled out. Also, these devices are relative sensitive which makes their transportation a problem. Other devices for measuring the moisture content of a moving sheet of paper during the manufacturing process of a papermaking machine are disclosed in U.S. Pat. Nos. 3,614,450 and 3,851,175. These devices employ moisture gauges having two detectors of different wavelengths. Typically, one wavelength is highly sensitive to the moisture and the other wavelength is relatively insensitive to the moisture. The ratio of the two signals is utilized to provide a signal representative of the absolute moisture content.

U.S. Pat. No. 3,847,730 discloses a similar system wherein maximum and minimum moisture signals are compared for determining moisture content in the manufacture of paper. U.S. Pat. No. 3,713,966 discloses a plurality of moisture gauges disposed across the width of the moving web which collectively indicate the moisture content of the web.

Accordingly, an important object of the present invention is to provide an apparatus and method for monitoring the de-watering efficiency of a forming section of a papermaking machine which are simple and reliable.

Another object of the present invention is to provide an apparatus and method for monitoring the de-watering efficiency of a forming section of a papermaking machine which does not require operation underneath the papermaking fabric on which the papermaking stock is carried.

Yet another object of the present invention is to provide an apparatus and method for monitoring the de-watering efficiency at various stations along the length of a forming section of a papermaking machine wherein the de-watering monitoring apparatus may be easily transported along the forming section for taking different measurements.

SUMMARY OF THE INVENTION

The above objectives are accomplished according to the invention by providing an apparatus for measuring the de-watering performance of a forming section of a papermaking machine which includes a laser instrument assembly have two laser displacement meters disposed above the paper stock deposited on an upper run of the forming fabric on the papermaking machine. A head box deposits paper stock consisting of a water/fiber mixture on top of the upper run of the forming fabric. A plurality of de-watering mechanisms are disposed in a sequential manner underneath the fabric and along the upper run of the fabric for removing water from the stock. The laser instrument assembly has a first and second laser beam. A carrier stand mounts the laser instrument assembly above the upper run of the forming fabric so that the first laser beam is reflected from a top surface of the paper stock and the second laser beam is reflected from a bare edge surface of the forming fabric which is devoid of the paper stock. Preferably, a first laser displacement meter is disposed in a first position above the forming fabric so that a laser beam of the first laser meter is reflected off of the paper stock which is deposited on top of the forming fabric. A second laser displacement meter is disposed in a second position above the forming fabric so that the laser beam of the second laser displacement meter is reflected off of a bare edge of the forming fabric. The laser meters generate first and second signals representing the displacement of the top surface of the paper stock and bare surface of the forming fabric. A controller is provided for receiving the first and second signals and generating an output representing the thickness of the paper stock, and hence the water content of said stock.

Preferably the carrier stand comprises at least one upstanding leg mounted to a side frame of the forming section of the papermaking machine, and includes a support arm carried by the upstanding leg on which the first and second laser meters are supported above the upper run of the forming fabric. The carrier stand may include a plurality of upstanding legs, and an adjustable base mounted between the support arm and the upstanding legs allowing the support arm to be adjusted longitudinally along the length of the forming fabric relative to the upstanding leg so a plurality of measurements may be taken along the forming fabric. The support arm is carried in a cantilevered manner by the adjustable base. An adjustable mount for the carrier stand allows the support arm and laser meters to be leveled.

A method of measuring the de-watering performance of a forming section of a papermaking machine includes measuring a first distance from a reference position to a top surface of the paper stock, and then measuring a second distance from the reference position to a bare surface of the forming fabric which is devoid of the paper stock. Next, first and second electrical signals are generated corresponding to the first and second distances and the first and second signals are processed to generate an output signal which represents the thickness of the paper stock as an indication of the water content of the paper stock at the reference position. The method includes measuring the thickness of the paper stock at a plurality of the reference positions along the length of the upper run of the forming fabric at various de-watering stations. Preferably, the method, the first and second distances are measured by using laser displacement meters disposed above the forming fabric at the reference position. The method comprises adjustably mounting the first and second laser displacement meters at lateral positions across the width of the fabric so that the first laser beam impinges upon the top surface of the paper stock and is reflected back to the first laser displacement meter, and the second laser beam impinges upon the bare surface of the forming fabric and is reflected back to the second laser displacement meter.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 2 is an enlarged perspective view of an apparatus and method according to the invention;

FIG. 3 is a sectional view taken along lines 3—3 of FIG. 2 illustrating an apparatus and method for monitoring the de-watering efficiency of a forming section of a papermaking machine according to the invention.

DESCRIPTION OF A PREFERRED EMBODIMENT

Figure 1:
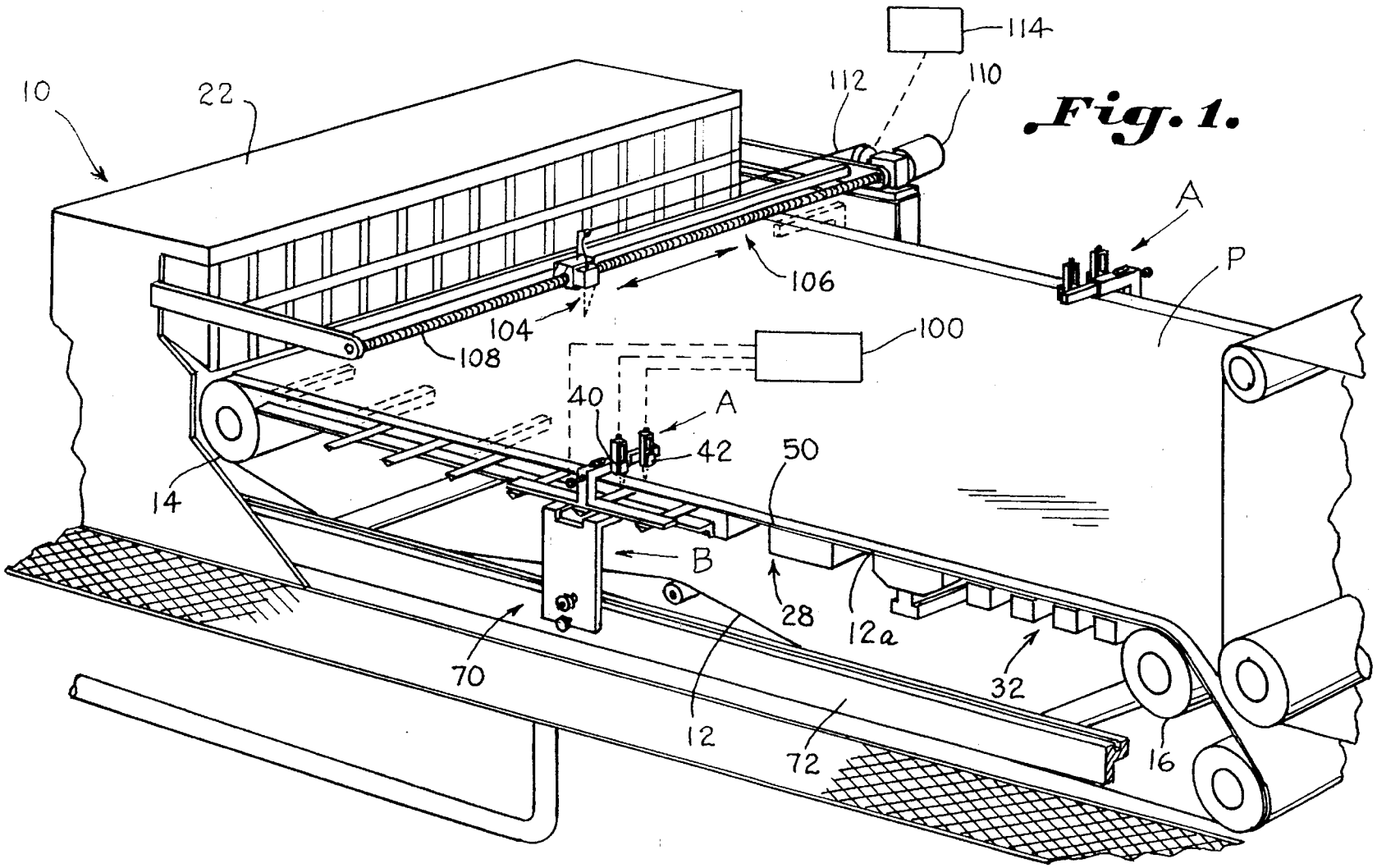
FIG. 1 is a perspective view illustrating an apparatus and method for monitoring the de-watering efficiency of a forming section of a papermaking machine according to the invention

Referring now in more detail to the drawings, a formation section of a papermaking machine, designated generally as 10, is illustrated. Typically, forming section 10 includes a papermaking fabric 12, which is commonly referred to as a fourdrinier or forming fabric or wire. Usually, the fabric or wire is formed from metal or plastic wires, e.g. plastic monofilaments. The mesh allows drainage from the paper stock supported on the fabric. The papermaking fabric travels about a breast roll 14, couch roll 16, drive roll 18, and a plurality of directional rolls 20. A head box 22 receives pulp fiber and water, mixes the water and fiber, and deposits the water/fiber mixture onto the papermaking fabric in a form commonly referred to as paper stock, which is designated generally as 24.

Figure 4:
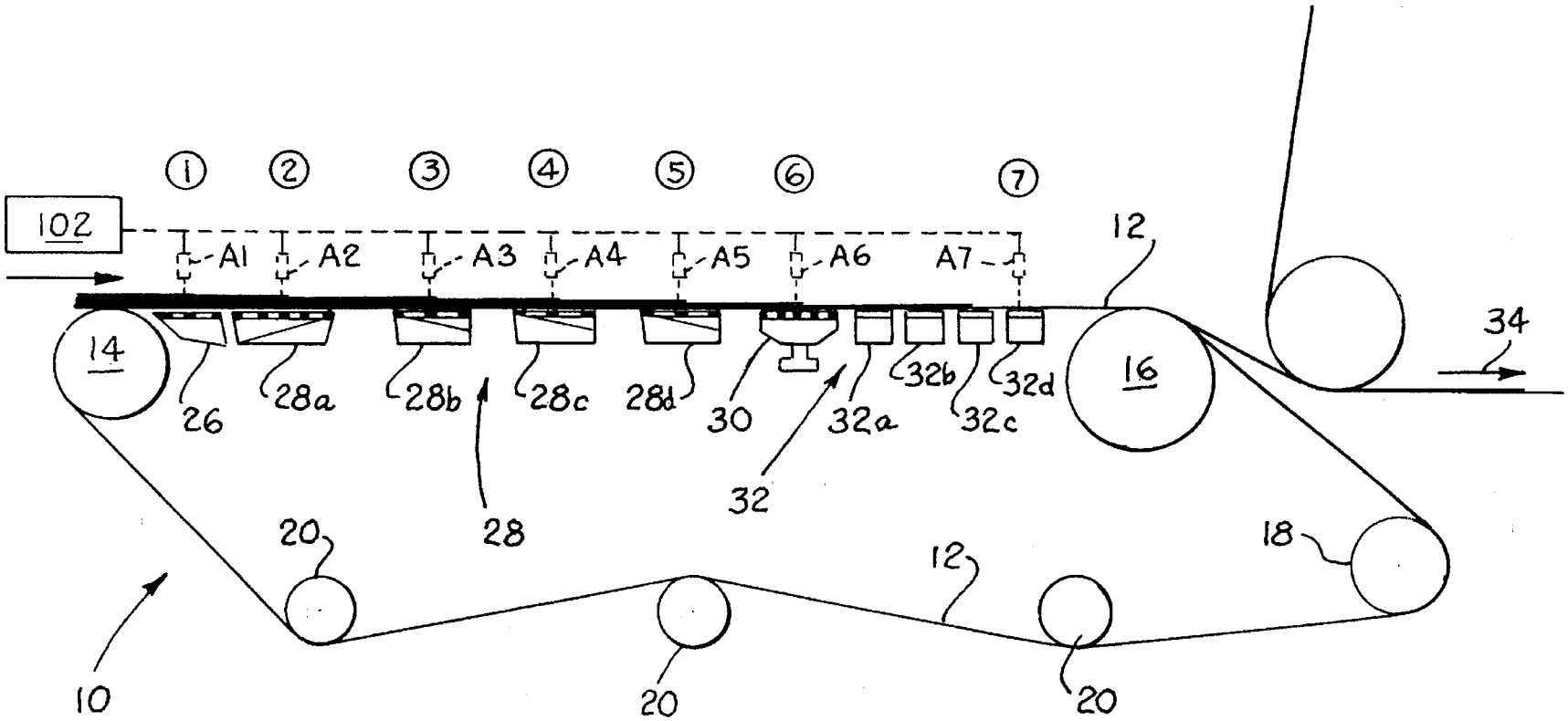
FIG. 4 is a side elevational view of the forming section of a papermaking machine illustrating an apparatus and method for monitoring the de-watering efficiency of the forming section according to the invention.

As can best be seen in FIGS. 1 and 4, the paper forming section has a plurality of de-watering devices disposed at sequential de-watering stations. For example, the de-watering devices may include a forming board 26, and a plurality of foil boxes 28, such as 28*a*, 28*b*, 28*c*, and 28*d*. Following the foil boxes, there is a vacuum foil 30 and a plurality of suction boxes 32 which include a suction box 32*a*, 32*b*, 32*c*, and 32*d*. Finally, there is suction couch roll 16 and the paper stock is transferred from the forming section to the press section intermediate the couch roll and the directional roll 18 as shown by arrow 34. Forming board 26 supports the fabric between breast roll 14 and first foil box 28*a* and can be adjusted to provide a desired amount of drainage and de-watering. Gravity removes the water which falls through the open mesh of the papermaking fabric into water trays disposed below the forming section so that the water may be recirculated. Foil boxes 28 remove water by hydrodynamic suction while also supporting the papermaking fabric. The foils can be placed closer together or further apart to adjust the drainage per unit area of the papermaking fabric supported on the foils. Suction boxes 32 remove water at progressively higher vacuum levels toward the couch roll 16. Couch roll 16 is driven to drive both the papermaking fabric and the rest of the rolls, and may be grooved. If a suction couch roll is used, there is a hollow shell with drilled holes and the roll is operated at relative high internal vacuum. It will be understood that the foregoing de-watering mechanisms and forming sections are conventional. Accordingly, the aforementioned description contains only those features as is necessary to the understanding of the invention.

Referring again to FIGS. 1 and 4, an apparatus and method for measuring and monitoring the de-watering performance of the forming section at various stations is illustrated. While monitoring of the de-watering may take place at any number of positions, de-watering is illustrated at stations 1–7 in the illustrated embodiment. Station 1 is at forming board 26. Positions 2–5 for monitoring de-watering efficiency are at foil boxes 28*a*–28*d*, respectively. De-watering monitoring position 6 is at vacuum foil 30. De-watering monitoring position 7 is at the last suction box 32*d* before the stock reaches the couch roll and is removed from the forming section and delivered to the press section as illustrated at area 34.

As can best be seen in FIGS. 2 and 3, an apparatus and method for measuring the de-watering performance of a forming section of a papermaking machine is illustrated which includes a laser instrument assembly, designated generally as A, which is supported above an upper run 12*a* of forming fabric 12 by means of a carrier stand, designated generally as B. Laser instrument assembly A includes a first laser displacement meter 40 and a second laser displacement meter 42 which is laterally displaced from meter 40. As illustrated, laser instrument assembly A includes a first laser beam 44 and a second laser beam 46. As can best be seen in FIG. 3, laser displacement meter 40 emits first laser beam 44 which includes a beam 44*a* which impinges upon a top surface 48 of paper stock P, and a reflected beam 44*b* which is reflected back and received by laser displacement meter 40. Similarly, second laser beam 46 includes a beam 46*a* which impinges upon a bare surface 50 of upper run 12*a* of forming fabric 12. There is a reflected beam 46*b* which reflects from the bare surface back to second laser displacement meter 42. A first signal 52 is generated by laser displacement meter 40 in response to first reflected laser beam 44*b*. A second electrical signal 54 is generated by second laser displacement meter 42 in response to reflected beam 46*b*. Signal 54 is delivered to a sub-controller 60 which generates a signal 62 representing the distance to bare surface 50 of forming fabric 12. Signal 62 is transmitted to a host controller 64 which receives signal 52 representing the distance to the top surface 48 of paper stock P. Host controller 64 processes signals 52 and 62 and determines a differential signal representing the thickness "t" of paper stock P. This thickness, of course, will vary according to, and represent the moisture or water content of the paper stock at the reference position at which the measurement is being made. By measuring the thickness of the paper stock at different de-watering stations or elements, an indication of the de-watering performance of the forming section can be had. For this purpose, carrier stand B is illustrated as including an adjustable base mount 70 for mounting the carrier stand to an associated structure 72 which may be a side frame of the forming section as illustrated in FIG. 2. In the illustrated embodiment, carrier stand B includes at least one upstanding leg 74 and a horizontal carrier stand arm 76 with a recess 76*a* for receiving a transversely extending de-watering element. Adjustable attachments 78 and 80 are provided for affixing leg 74 to associated structure 72. In some machines, forming sections include side frames 72 with a slot 72*a*. In this particular embodiment, the adjustable attachment 78 preferably includes an L-shaped bolt 78*a* having a threaded end 78*b*. A nylon bushing 82 is inserted through upstanding leg 74, as can best be seen in FIG. 3. Threaded bolt 78*a* slides and rotates relative to this bushing. An adjustable turn knob 78*c* is threaded onto threaded end 78*b*. Threaded turn screw 80 is threaded into upstanding leg 74 as can also best be seen in FIG. 3. A cantilevered support arm 84 is affixed to a cross-brace 86 which is affixed to horizontal stand arm 76 (FIG. 2). By adjusting turn screw 78*c* and turn knob 80, the level condition of cantilevered support arm 84 may be adjusted so that displacement meters 42 and 40 are in a level condition in the measuring reference position. For this purpose, a spirit level 85 may be affixed to arm 84. A vertical slot may be provided in leg 74 to accommodate adjusting bolt 78 (and bushing 82) to provide vertical adjustment of the carried stand, if needed.

Preferably, displacement meters 40, 42 are adjustably carried by support arm 84 so that reliable positioning over the fabric and paper stock or sheet can be had. In the illustrated embodiment, this includes a slidable arm insert 84*a* received in an arm sleeve 84*b* which are included in arm 84. Each displacement meter 40, 42 is carried by a vertical adjustment brackets or mechanisms 88, 90 having micrometer-type turn screws 88*a*, 90*a* providing fine adjustment. Screws 88*a*, 90*a* are threadably journaled in back blocks to which meters 40, 42 are attached by any suitable manner so that the turn screws move the meters up and down in precision movements. The back blocks are constrained and guided by slide ways 88*b*, 90*b*. Also, there is a lateral adjustment for the individual adjustment brackets 88, 90 so that they may be individually adjusted laterally with respect to fabric 12 and paper stock or sheet P. Bracket 90 is attached to slidable arm insert 84*a*. Insert arm 84*a* is threadably journaled to a fine adjustment screw rod 92 which is journaled into vertical post 86*a*. Bracket 88 is affixed to arm sleeve 84*b* by means of removable bolts (not shown) so that its lateral position on arm 84*b* may be varied using mounting holes 94.

It is also contemplated that the turning and control of lateral adjustment turn screw 92, and vertical adjustment turn screws 88*a*, 90*a* be accomplished electronically and from a remote location using any suitable means, such as electro/mechanical servos, as is well within the purview of one skilled in the art. This may be necessitated by the fact that the turning screws, so described, may be out of manual reach when the apparatus is installed for measuring/monitoring on a forming section of a papermaking machine. A suitable remote control for the turn screws is shown at 100.

The vertical and lateral fine adjustments of displacement meters 40, 42 assures reliable measurements of the thickness "t" and hence the water content of paper stock P at the various positions. A measurement(s) may be taken at one station, and then the carrier stand may be moved to a different de-watering station for measuring and monitoring the water performance at that different station, for example, at stations 1–7 in FIG. 4. Any suitable displacement meters may be utilized. One suitable displacement meter is a laser displacement meter manufactured by the Keyence Corporation of Osaka, Japan under the model designation KEYENCE LC-2320, and is available from the Keyence Corporation of America, Fair Lawn, N.J. Sub-controller 60 may be any suitable programmed logic controller (PLC) as may be host controller 64. The controller may be suitably programmed to perform a frequency analysis on the two laser beam signals, and provide a thickness signal representing the difference in their displacement (distance) measurements. The output 68 from host controller 64, may be any suitable RS-232 output which may be delivered to an external computer. Alternately, the output may be displayed by the host controller on an associated display panel.

In another embodiment of the invention, a series of laser instruments are illustrated schematically at FIG. 4 as A2 through A7. The laser units are mounted generally in a straight line down the length of the wet end section of the papermaking machine in the machine direction. Displacement signals from the various laser units are delivered to a suitable electronic control 102 which monitors, and automatically controls the de-watering performance of the de-watering devices at the wet end. This may be accomplished by automatically adjusting the angle of the foil blades and expanding the nip of the foils 28, and adjusting and controlling the vacuum in suction boxes 30, 32. In this manner, the performances of the various de-watering mechanisms along the length of the forming section can automatically be monitored and an adjustment be made to assure that the de-watering performance desired is achieved automatically during the process.

In another embodiment of the invention, as can best be seen in FIG. 1, a laser displacement meter 104 may be disposed on a suitable cross beam, designated generally as 106, which includes a worm 108 on which laser displacement unit 104 traverses back and forth across the width of the paper stock and forming fabric. For this purpose, a drive motor 103 is provided for turning the worm in reversing directions to move the laser displacement unit in reciprocal directions back and forth across the stock and fabric. In this manner, information can be obtained about any variations in the stock weight across the width of the forming section. Any variations in stock weight can be compensated for by making adjustments to the discharge openings in head box 32 so that a uniform weight of paper stock is distributed across the forming section. Displacement signals from laser meter unit 104 may be fed over suitable control line 112 to a control 114, and analyzed for controlling the discharge openings so that a uniform stock weight is maintained across the forming section.

While a preferred embodiment of the invention has been described using specific terms, such description is for illustrative purposes only, and it is to be understood that changes and variations may be made without departing from the spirit or scope of the following claims.

What is claimed is:

1. An apparatus for measuring the de-watering performance of a forming section of a papermaking machine, said forming section including an endless paper forming fabric which travels about a plurality of rolls; said paper forming fabric having an upper run, a head box for depositing paper stock consisting of a water/fiber mixture on top of said upper run of said forming fabric; a plurality of de-watering mechanisms disposed sequentially underneath said fabric along said upper run of said fabric for removing water from said stock; wherein said apparatus comprises:

a carrier stand;

a laser instrument assembly carried by said carrier stand having a first laser beam and a second laser beam;

said carrier stand mounting said laser instrument assembly above said upper run of said forming fabric so that said first laser beam is reflected from a top surface of said paper stock and said second laser beam is reflected from a bare edge surface of said forming fabric which is devoid of said paper stock;

said laser assembly including a receiver for receiving said reflected beams of said first and second laser beams and generating said first and said second signals corresponding to said reflected beams; and a controller for receiving said first and second signals for generating an output representative of a thickness of said paper stock, and hence the water content of said stock.

2. The apparatus of claim 1 wherein said carrier stand comprises a support arm on which said laser instrument assembly is carried above said upper run of said forming fabric.

3. The apparatus of claim 2 wherein said carrier stand includes an upstanding base leg on which said support arm is carried, and an adjustable base mount carried near a lower portion of said carrier stand which attaches base leg to said associated structure and is constructed and arranged to adjust the level condition of a support arm on which said first and second laser displacement meters are carried.

4. The apparatus of claim 2 wherein said support arm includes a laterally adjustable support by which said laser instrument assembly may be adjusted in its lateral position above said upper run.

5. The apparatus of claim 4 wherein said carrier stand comprises a fine vertical adjustment securing said laser instrument assembly to said support arm by which a vertical position of said instrument assembly may be adjusted relative to said upper fabric run and/or paper stock.

6. The apparatus of claim 1 wherein said carrier stand comprises an adjustable base mount for mounting said carrier stand to an associated structure of said forming section so that the position of said laser instrument assembly along said forming fabric may be adjusted.

7. The apparatus of claim 1 wherein said laser instrument assembly includes at least first and second laser displacement meters for emitting and receiving back said first and second laser beams, respectively.

8. The apparatus of claim 7 wherein said carrier stand includes a fine vertical adjustment mechanism for individually adjusting the vertical positions of said first and second displacement meters above said upper run and paper stock.

9. The apparatus of claim 8 wherein said carrier stand includes a lateral adjustment mechanism for individually adjusting the lateral positions of said first and second displacement meters above said upper run and paper stock.

10. The apparatus of claim 9 including a remote control for actuating said fine vertical adjustment from a remote location.

11. The apparatus of claim 7 wherein said carrier stand includes a lateral adjustment mechanism for individually adjusting the lateral positions of said first and second displacement meters above said upper run and paper stock.

12. An apparatus for measuring the de-watering performance of a forming section of a papermaking machine, said forming section including an endless paper forming fabric which travels about a plurality of rolls; said paper forming fabric having an upper run, a head box for depositing paper stock consisting of a water/fiber mixture on top of said upper run of said forming fabric; a plurality of de-watering mechanisms disposed sequentially underneath said fabric along said paper run of said fabric for removing water from said stock; wherein said apparatus comprises:

a first laser displacement meter disposed in a first position above said forming fabric so that a laser beam of said first laser meter is reflected off of said paper stock deposited on top of said forming fabric;

a second laser displacement meter disposed in a second position above said forming fabric so that a laser beam of said second laser displacement meter is reflected off of a bare edge of said forming fabric;

a carrier stand for supporting said first and second laser displacement meters in said first and second positions above said upper run of said forming fabric.

13. The apparatus of claim 12 wherein said carrier stand comprises a horizontal support on which said first and second laser meters are carried above said upper run of said forming fabric in a laterally spaced configuration.

14. The apparatus of claim 13 wherein said carrier stand includes an adjustable base mount which may be attached to an associated structure of said papermaking machine so that said support may be adjusted longitudinally along the length of said forming fabric whereby a plurality of measurements may be taken along said forming fabric.

15. The apparatus of claim 13 wherein said horizontal support includes a laterally adjustable support by which relative positions of said first and second displacement meters may be adjusted laterally above said upper run.

16. The apparatus of claim 15 wherein said carrier stand comprises a fine vertical adjustment securing at least one of said first and second displacement meters to said support for vertical adjustment of said one displacement meter relative to said upper fabric run and/or paper stock.

17. The apparatus of claim 13 wherein said carrier stand comprises a fine vertical adjustment securing at least one of said first and second displacement meters to said support for adjusting a vertical position of said one displacement meter relative to said upper fabric run and/or paper stock.

18. The apparatus of claim 17 including a remote control for actuating said fine vertical adjustment from a remote location.

19. The apparatus of claim 13 wherein said carrier stand comprises an adjustable base mount for mounting said carrier stand to an associated structure of said forming section so that the position of said laser instrument assembly along said forming fabric may be adjusted.

20. The apparatus of claim 19 wherein said carrier stand comprises at least one upstanding leg, and said adjustable mount comprises an adjustable attachment carried by said leg which attaches to a side frame of said associated structure of said forming section.

21. The apparatus of claim 20 wherein said adjustable attachment fits within a slot formed in said side frame.

22. The apparatus of claim 13 including a controller for receiving first and second signals corresponding to said first and second reflected laser beams, and said controller processing said first and second signals for generating an output representative of a thickness and hence water content of said paper stock.

23. A method of measuring the de-watering performance of a forming section of a papermaking machine wherein said forming section includes an endless paper forming fabric which travels about a plurality of rolls; said paper forming fabric having an upper run, a head box for depositing paper stock consisting of a water/fiber mixture on top of said upper run; a plurality of de-watering mechanisms disposed sequentially underneath said fabric along said upper run for removing water from said paper stock, wherein said method comprises:

providing a measurement reference position;

measuring a first distance from said reference position to a top surface of said paper stock;

measuring a second distance from said reference position to a bare surface of said forming fabric which is devoid of said paper stock;

generating first and second electrical signals corresponding to said first and second distances and possessing said first and second signals to generate an output signal representative of a thickness of said paper stock as an indication of the water content of said paper stock at said reference position.

24. The method of claim 23 comprising measuring said thickness of said paper stock at a plurality of said reference positions along a length of said upper run of said forming fabric at various de-watering stations.

25. The method of claim 23 comprising measuring said first and second distances by using first and second laser displacement meters disposed above said forming fabric at said reference position.

26. The method of claim 25 comprising adjustably mounting said first and second laser displacement meters at lateral positions across the width of said fabric so that said first laser beam impinges upon said top surface of said paper stock and is reflected back to said first laser displacement meter, and said second laser beam impinges upon said bare surface of said forming fabric and is reflected back to said second laser displacement meter.

27. The method of claim 26 comprising supporting said first and second laser displacement meters on a carrier stand which may be moved along the length of said forming fabric.

28. The method of claim 27 including mounting said first and second displacement meters on a cantilevered support arm carried by said carrier stand and adjusting the level condition of said support arm at said referenced position to assure that said first and second displacement meters are level when supporting said first and second laser displacement meters above said forming fabric.

29. The method of claim 27 including adjusting said support arm longitudinally along the length of said forming fabric relative to said carrier stand whereby a plurality of measurements may be taken along said forming fabric.

30. The method of claim 25 comprising adjusting the relative lateral and vertical positions of said first and second displacement meters from a remote location.

* * * * *